US010920522B1

(12) United States Patent
Robichaux et al.

(10) Patent No.: US 10,920,522 B1
(45) Date of Patent: Feb. 16, 2021

(54) ROTATING AND RECIPROCATING SWIVEL APPARATUS AND METHOD

(71) Applicant: Mako Rentals, Inc., Schriever, LA (US)

(72) Inventors: Kip M. Robichaux, Houma, LA (US); Terry P. Robichaux, Houma, LA (US)

( * ) Notice: Subject to any disclaimer, the term of this patent is extended or adjusted under 35 U.S.C. 154(b) by 85 days.

(21) Appl. No.: 16/416,404

(22) Filed: May 20, 2019

Related U.S. Application Data

(63) Continuation of application No. 15/093,357, filed on Apr. 7, 2016, now Pat. No. 10,294,747.

(60) Provisional application No. 62/143,991, filed on Apr. 7, 2015.

(51) Int. Cl.
*E21B 33/08* (2006.01)

(52) U.S. Cl.
CPC ..... *E21B 33/085* (2013.01)

(58) Field of Classification Search
CPC ..... E21B 33/068; E21B 33/085; E21B 33/08; E21B 33/076; E21B 19/16
See application file for complete search history.

(56) References Cited

U.S. PATENT DOCUMENTS 3,215,203 A * 11/1965 Sizer ..... E21B 19/002 166/77.4
3,559,739 A * 2/1971 Hutchison ..... E21B 37/00 166/311
4,553,637 A * 11/1985 Tanner ..... A47L 25/00 15/220.4
5,865,245 A * 2/1999 Trout ..... E21B 33/08 166/177.3
5,988,274 A * 11/1999 Funk ..... E21B 19/08 166/77.4
6,352,129 B1 * 3/2002 Best ..... E21B 19/16 175/25
6,688,394 B1 * 2/2004 Ayling ..... E21B 21/01 166/380
6,739,397 B2 * 5/2004 Ayling ..... E21B 33/068 166/380
9,022,126 B2 * 5/2015 Melancon ..... E21B 33/08 166/360
9,874,065 B2 * 1/2018 Christensen ..... E21B 17/01
2004/0159465 A1 * 8/2004 Ayling ..... E21B 33/068 175/57
2007/0175626 A1 * 8/2007 Lam ..... E21B 33/062 166/85.4
2012/0292054 A1 * 11/2012 Orbell ..... E21B 7/12 166/387
2017/0335649 A1 * 11/2017 Hansen ..... E21B 33/035

* cited by examiner

*Primary Examiner* — Kipp C Wallace
(74) *Attorney, Agent, or Firm* — Roy Kiesel Ford Doody & North, APLC; Brett A. North

(57) ABSTRACT

What is provided is a method and apparatus wherein a rotating and reciprocating swivel of adjustable stroke length and shearable by ram blow out preventers can be detachably connected to an annular blowout preventer thereby separating the lower wellbore from the riser. In one embodiment the mandrel of the swivel extends through a sleeve/housing. The sleeve/housing has a wiping arrangement of improved configuration that wipes debris from the mandrel, preventing entry of the debris into the sleeve/housing. Ports enable discharge of the removed debris from the area of the sleeve/housing.

18 Claims, 6 Drawing Sheets

ROTATING AND RECIPROCATING SWIVEL APPARATUS AND METHOD

CROSS-REFERENCE TO RELATED APPLICATIONS

This is a continuation of U.S. full utility patent application Ser. No. 15/093,357, filed Apr. 7, 2016 (issuing on May 21, 2019 as U.S. Pat. No. 10,294,747), which application claimed the benefit of U.S. provisional patent application Ser. No. 62/143,991, filed Apr. 7, 2015, each of which applications are hereby incorporated herein by reference in their entirety, and priority to/from each of which applications is hereby claimed.

U.S. patent application Ser. No. 13/793,260, filed on Mar. 11, 2013, is incorporated herein by reference in its entirety.

STATEMENT REGARDING FEDERALLY SPONSORED RESEARCH OR DEVELOPMENT

Not applicable

REFERENCE TO A "MICROFICHE APPENDIX"

Not applicable

BACKGROUND

In deepwater drilling rigs, marine risers extending from a wellhead fixed on the ocean floor have been used to circulate drilling fluid or mud back to a structure or rig. The riser must be large enough in internal diameter to accommodate a drill string or well string that includes the largest bit and drill pipe that will be used in drilling a borehole. During the drilling process drilling fluid or mud fills the riser and wellbore.

BRIEF SUMMARY

The method and apparatus of the present invention solves the problems confronted in the art in a simple and straightforward manner.

One embodiment relates to a method and apparatus for deepwater rigs. In particular, one embodiment relates to a method and apparatus for performing downhole operations at a time when the annular blow out preventer is closed.

In one embodiment displacement is contemplated in water depths in excess of about 5,000 feet (1,524 meters).

One embodiment provides a method and apparatus having a swivel which can operably and/or detachably connect to an annular blowout preventer thereby separating the fluid or mud into upper and lower sections.

In one embodiment a swivel tool can be used having a sleeve or housing that is rotatably and sealably connected to a mandrel. The swivel can be incorporated into a drill or well string.

In one embodiment the sleeve or housing can be fluidly sealed to and/or from the mandrel by a pair of spaced apart sealing units.

In one embodiment the sleeve or housing can be fluidly sealed with respect to the outside environment by a pair of spaced apart sealing units.

In one embodiment the sealing system between the sleeve or housing and the mandrel is designed to resist fluid infiltration from the exterior of the sleeve or housing to the interior space between the sleeve or housing and the mandrel.

In one embodiment the sealing system between the sleeve or housing and the mandrel is designed to resist fluid infiltration from the interior space between the sleeve or housing and the mandrel to the exterior.

In one embodiment the sealing system between the sleeve or housing and the mandrel has a substantially equal pressure ratings for pressures tending to push fluid from the exterior of the sleeve or housing to the interior space between the sleeve or housing and the mandrel and pressures tending to push fluid from the interior space between the sleeve or housing and the mandrel to the exterior of the sleeve or housing.

In one embodiment a swivel having a sleeve or housing and mandrel is used having at least one flange, catch, or upset to restrict longitudinal movement of the sleeve or housing relative to the annular blow out preventer. In one embodiment a plurality of flanges, catches, or upsets are used. In one embodiment the plurality of flanges, catches, or upsets are longitudinally spaced apart with respect to the sleeve or housing.

The swivel tool can be closed on by the annular blowout preventer ("annular BOP"). Typically, the annular BOP is located immediately above the ram BOP which ram BOP is located immediately above the sea floor and mounted on the well head. As an integral part of the string, the mandrel of the rotating and reciprocating tool supports the full weight, torque, and pressures of the entire string located below the mandrel.

In one embodiment, at least partly during the time the annular seal is closed on the sleeve of the swivel, the drill or well string is intermittently stroked longitudinally during downhole operations, such as in a hydraulic fracturing job.

In one embodiment the rotational speed is reduced during the time periods that reciprocation is not being performed. In one embodiment the rotational speed is reduced from about 60 revolutions per minute to about 30 revolutions per minute when reciprocation is not being performed.

In one embodiment, at least partly during the time the annular seal is closed on the sleeve of the swivel, the drill or well string is reciprocated longitudinally. In one embodiment a reciprocation stroke of about 65.5 feet (20 meters) is contemplated. In one embodiment about 20.5 feet (6.25 meters) of the stroke is contemplated for allowing access to the bottom of the well bore. In one embodiment about 35, about 40, about 45, and/or about 50 feet (about 10.67, about 12.19, about 13.72, and/or about 15.24 meters) of the stroke is contemplated for allowing at least one pipe joint-length of stroke during reciprocation. In one embodiment reciprocation is performed up to a speed of about 20 feet per minute (6.1 meters per minute).

In one embodiment one or more brushes and/or scrapers are used in the method and apparatus.

In one embodiment a mule shoe is used in the method and apparatus.

Catches

The annular BOP is designed to fluidly seal on a large range of different sized items—e.g., from 0 inches to 18¾ inches (0 to 47.6 centimeters) (or more). However, when an annular BOP fluid seals on the sleeve of the rotating and reciprocating tool, fluid pressures on the sleeve's exposed effective cross sectional area exert longitudinal forces on the sleeve. These longitudinal forces are the product of the fluid pressure on the sleeve and the sleeve's effective cross sectional area. Where different pressures exist above and below the annular BOP (which can occur in completions having multiple stages), a net longitudinal force will act on the sleeve tending to push it in the direction of the lower fluid pressure. If the differential pressure is large, this net longitudinal force can overcome the frictional force applied by the closed annular BOP on the sleeve and the frictional forces between the sleeve and the mandrel. If these frictional forces are overcome, the sleeve will tend to slide in the direction of the lower pressure and can be "pushed" out of the closed annular BOP. In one embodiment catches are provided which catch onto the annular BOP to prevent the sleeve from being pushed out of the closed annular BOP.

For example, lighter sea water above the annular BOP seal and heavier drilling mud, or weighted pills, and/or weighted completion fluid, or a combination of all of these can be below the annular BOP requiring an increased pressure to push such fluids from below the annular BOP up through the choke line and into the rig (at the selected flow rate). This pressure differential (in many cases causing a net upward force) acts on the effective cross sectional area of the tool defined by the outer diameter of the string (or mandrel) and the outer diameter of the sleeve. For example, the outer sealing diameter of the tool sleeve can be 9¾ inches (24.77 centimeters) and the outer diameter of the tool mandrel can be 7 inches (17.78 centimeters) providing an annular cross sectional area of 9¾ inches (24.77 centimeters) OD and 7 inches ID (17.78 centimeters). Any differential pressure will act on this annular area producing a net force in the direction of the pressure gradient equal to the pressure differential times the effective cross sectional area. This net force produces an upward force which can overcome the frictional force applied by the annular BOP closed on the tool's sleeve causing the sleeve to be pushed in the direction of the net force (or slide through the sealing element of the annular BOP). To resist sliding through the annular BOP, catches can be placed on the sleeve which prevent the sleeve from being pushed through the annular BOP seal.

In any of the various embodiments, the following differential pressures (e.g., difference between the pressures above and below the annular BOP seal) can be axially placed upon the sleeve or housing against which the catches can be used to prevent the sleeve from being axially pushed out of the annular BOP (even when the annular BOP seal has been closed)—in pounds per square inch: 500, 750, 1000, 1250, 1500, 1750, 2000, 2250, 2500, 2750, 3000, 3250, 3,500, 3750, 4,000, 4,250, 4,500, 4,750, 5,000, 10,000 or greater (3,450, 5,170, 6,900, 8,620, 10,340, 12,070, 13,790, 15,510, 17,240, 18,960, 20,690, 22,410, 24,130, 25,860, 27,700, 29,550, 31,400, 33,240, 35,090, 36,940, 73,880 kilopascals). Additionally, ranges between any two of the above specified pressures are contemplated. Additionally, ranges above any one of the above specified pressures are contemplated. Additionally, ranges below any one of the above specified pressures are contemplated. These differential pressures can be higher below the annular BOP seal or above the annular BOP seal.

Quick Lock/Quick Unlock

After the sleeve and mandrel have been moved relative to each other in a longitudinal direction, a downhole/underwater locking/unlocking system is needed to lock the sleeve in a longitudinal position relative to the mandrel (or at least restricting the available relative longitudinal movement of the sleeve and mandrel to a satisfactory amount compared to the longitudinal length of the sleeve's effective sealing area). Additionally, an underwater locking/unlocking system is needed which can lock and/or unlock the sleeve and mandrel a plurality of times while the sleeve and mandrel are underwater.

In one embodiment is provided a system wherein the underwater position of the longitudinal length of the sleeve's sealing area (e.g., the nominal length between the catches) can be determined with enough accuracy to allow positioning of the sleeve's effective sealing area in the annular BOP for closing on the sleeve's sealing area. After the sleeve and mandrel have been longitudinally moved relative to each other when the annular BOP was closed on the sleeve, it is preferred that a system be provided wherein the underwater position of the sleeve can be determined even where the sleeve has been moved outside of the annular BOP.

In one embodiment is provided a quick lock/quick unlock system for locating the relative position between the sleeve and mandrel. Because the sleeve can reciprocate relative to the mandrel (i.e., the sleeve and mandrel can move relative to each other in a longitudinal direction), it can be important to be able to determine the relative longitudinal position of the sleeve compared to the mandrel at some point after the sleeve has been reciprocated relative to the mandrel. For example, in various uses of the rotating and reciprocating tool, the operator may wish to seal the annular BOP on the sleeve sometime after the sleeve has been reciprocated relative to the mandrel and after the sleeve has been removed from the annular BOP.

To address the risk that the actual position of the sleeve relative to the mandrel will be lost while the tool is underwater, a quick lock/quick unlock system can detachably connect the sleeve and mandrel. In a locked state, this quick lock/quick unlock system can reduce the amount of relative longitudinal movement between the sleeve and the mandrel (compared to an unlocked state) so that the sleeve can be positioned in the annular BOP and the annular BOP relatively easily closed on the sleeve's longitudinal sealing area. Alternatively, this quick lock/quick unlock system can lock in place the sleeve relative to the mandrel (and not allow a limited amount of relative longitudinal movement). After being changed from a locked state to an unlocked state, the sleeve can experience its unlocked amount of relative longitudinal movement.

In one embodiment is provided a quick lock/quick unlock system which allows the sleeve to be longitudinally locked and/or unlocked relative to the mandrel a plurality of times when underwater. In one embodiment the quick lock/quick unlock system can be activated using the annular BOP.

In one embodiment the sleeve and mandrel can rotate relative to one another even in both the activated and un-activated states. In one embodiment, when in a locked state, the sleeve and mandrel can rotate relative to each other. This option can be important where the annular BOP is closed on the sleeve at a time when the string (of which the mandrel is a part) is being rotated. Allowing the sleeve and mandrel to rotate relative to each other, even when in a locked state, minimizes wear/damage to the annular BOP caused by a rotationally locked sleeve (e.g., sheer pin) rotating relative to a closed annular BOP. Instead, the sleeve can be held fixed rotationally by the closed annular BOP, and the mandrel (along with the string) rotates relative to the sleeve.

In one embodiment, when the locking system of the sleeve is in contact with the mandrel, locking/unlocking is performed without relative rotational movement between the locking system of the sleeve and the mandrel—otherwise scoring/scratching of the mandrel at the location of lock can occur. In one embodiment, this can be accomplished by rotationally connecting to the sleeve the sleeve's portion of quick lock/quick unlock system. In one embodiment a locking hub is provided which is rotationally connected to the sleeve.

In one embodiment a quick lock/quick unlock system on the rotating and reciprocating tool can be provided allowing the operator to lock the sleeve relative to the mandrel when the rotating and reciprocating tool is downhole/underwater. Because of the relatively large amount of possible stroke of the sleeve relative to the mandrel (i.e., different possible relative longitudinal positions), knowing the relative position of the sleeve with respect to the mandrel can be important. This is especially true at the time the annular BOP is closed on the sleeve. The locking position is important for determining relative longitudinal position of the sleeve along the mandrel (and therefore the true underwater depth of the sleeve) so that the sleeve can be easily located in the annular BOP and the annular BOP closed/sealed on the sleeve.

During the process of moving the rotating and reciprocating tool underwater and downhole, the sleeve can be locked relative to the mandrel by a quick lock/quick unlock system. In one embodiment the quick lock/quick unlock system can, relative to the mandrel, lock the sleeve in a longitudinal direction. In one embodiment the sleeve can be locked in a longitudinal direction with the quick lock/quick unlock system, but the sleeve can rotate relative to the mandrel during the time it is locked in a longitudinal direction. In one embodiment the quick lock/quick unlock system can simultaneously lock the sleeve relative to the mandrel, in both a longitudinal direction and rotationally. In one embodiment the quick lock/quick unlock system can, relative to the mandrel, lock the sleeve rotationally, but at the same time allow the sleeve to move longitudinally.

GENERAL EMBODIMENTS

In one embodiment the mandrel is comprised of a plurality of joints of piping/tubing which are threadably connected to each other.

In one embodiment a sleeve/housing is rotatably and slidably connected to the mandrel.

In one embodiment the sleeve/housing includes a pair of spaced apart sealing units which sealingly engage the sleeve/housing relative to the external surface of the mandrel during the time period the sleeve is slidably and/or rotatably connected to the mandrel.

In one embodiment the sleeve/housing can remain stationary while a portion of the mandrel is moved longitudinally or stroked relative to the sleeve.

In one embodiment the mandrel can be stroked or passed through the reciprocable and rotatable sleeve/housing while the sleeve/housing is maintained stationary relative to an annular blow out preventer, and with the annular blow out preventer maintaining a seal on the sealing area of the sleeve/housing. With the seal between the sleeve/housing and the mandrel, in combination with the seal between the annular of the annular blow out preventer and the sealing area of the sleeve, a fluid seal can be maintained between above and below the annular seal of the annular blow out preventer even when the mandrel is stroked and/or rotating. Such allows any drill string, tools, and/or other items located below the mandrel to be rotated and/or reciprocated while the closed annular blow out preventer maintains a seal on the wellbore, and without the annular seal of the annular blowout preventer being subjected to differential movement which differential movement can damage the annular seal.

One embodiment allows the stroking area of the mandrel to slide relative to the sleeve/housing, thereby providing the benefit of longitudinal movement and/or rotation but substantially eliminating differential movement of any item in contact with the closed annular sealing element relative to the closed annular sealing element. Accordingly, the risk of damage to the closed annular sealing element is substantially eliminated.

Shearable Mandrel Design

One embodiment provides a downhole swivel tool comprising a longitudinal mandrel with a longitudinal interior passageway, the mandrel having a sleeve/housing slidably connected to the mandrel, wherein the mandrel can rotate and reciprocate/stroke relative to the sleeve, and wherein sleeve/housing and the mandrel is sealed in a longitudinal direction.

There is a long felt but unsolved need to have a swivel tool including a mandrel that is shearable relative to a plurality of stacked ram type blow out preventers regardless of the position of the mandrel relative to the stack of ram type blow out preventers.

In one embodiment, within the stroking length of the mandrel, the exterior mandrel sealing surface can be kept substantially at a uniform diameter to maintain a longitudinal seal with respect to the sleeve/housing.

One embodiment of the swivel tool provides a mandrel, within the stroking length of the mandrel, the exterior mandrel sealing surface being kept at a substantially uniform diameter to maintain a longitudinal seal with respect to the sleeve/housing, within this stroking length the mandrel having a interior axial passageway, the interior axial passageway having first and second diameters, the first diameter being larger than the second diameter, with the longitudinal spacing of the sections of mandrel having first diameter to sections having second diameter being such that at any one point at least one ram of a plurality of stacked ram blow out preventers would attempt to shear a section of the mandrel having the first diameter thereby ensuring continuous shearability of the mandrel.

In one embodiment the exterior sealing surface of the mandrel can have one or more recessed areas. In one embodiment the sleeve/housing can have a plurality of spaced apart sealing units, such that at any one time during stroking/rotation of the mandrel relative to the sleeve at least one of the spaced apart sealing units maintains a seal between the mandrel and the sleeve even when the other sealing unit is located above a recessed area of the mandrel.

In one embodiment the one or more recessed areas can be used to vertically support the mandrel when making up or breaking out the mandrel when at a rig bore.

In one embodiment the one or more recessed areas can be located on pin/male by pin/male joints of mandrel which pin/male by pin/male pin joints have a larger wall thickness relative to the wall thickness of the box/female by box/female joints of mandrel.

In one embodiment the smallest diameter of the one or more recessed areas can be between the diameter of the axial passage through the pin/male by pin/male joint and the axial diameter of the axial passage of the box/female by box/female joint.

In one embodiment the mandrel is constructed of multiple joints of box/female to box/female ends having thin walled tubing/piping meeting predefined shearing constraints for a specified ram type blow out preventer.

Because of manufacturing ease, typically the longitudinal passage through a joint of tubular is substantially the same size.

In detachably threaded connections (e.g., male and female threads) for joints of tubulars, the male portion of the connection being concentric with the female portion of the connection, with the male portion being interior to the female portion of such connection, the largest longitudinal passage through the male portion of such connection is necessarily smaller than the largest longitudinal passage through the female portion of the connection.

With a joint of tubular having a pin/male by box/female end, the largest possible size of longitudinal axial passage is controlled by the size of the smaller interiorly concentric pin end connection. With a joint of tubular having a box/female by box/female end connection, now the largest possible size of longitudinal passage is controlled by the size of the exteriorly concentric box/female end connection, and can be larger than the size of a mating interiorly concentric pin/male end connection.

Now a mandrel formed by such combination of joints of box/female by box/female end joints alternatively connected by pin/male by pin/male end joints of tubular can have spaced apart thin walled portions that are easily shearable by ram type blow out preventers. The spacing apart of the thin walled portions can be on opposing sides of the pin/male by pin/male joints of mandrel. The alternative box/female by box/female with pin/male by pin/male can have length spacings such that at any one point at least one ram of the plurality of stacked ram blow out preventers would attempt to shear a thin walled portion of the mandrel thereby ensuring continuous shearability of the mandrel.

The mandrel can comprise one or more joints of tubing or piping with box/female by box/female ends and each joint being approximately 30 feet in length.

Connecting the box/female by box/female ended joints of tubing/piping can be joints of pipe which are pin/male by pin/male type connections, with each of these pin by pin joints being approximately 30 inches in length.

The mandrel stroking area can include a longitudinal length of combined plurality of mandrel joints where such joints have a substantially uniform outer sealing diameter.

Threading can be used to detachably connect the mandrel joints to each other.

In one embodiment a reduced diameter groove/area can be machined on the surface of one or more of the stroking joints of mandrel. In one embodiment the reduced diameter groove/area is provided in the pin by pin stroking joint of mandrel.

In one embodiment the reduced diameter groove/area can be used to lift or lower together the tool with bottleneck elevators.

In one embodiment an annular seal between joints of mandrel can be activated by rotating one mandrel joint relative to a second mandrel joint.

In one embodiment is provided plurality of joints of mandrel where the box or female end has a tapered end shoulder which cooperates with a tapered shoulder of a mating pin/male end joint to prevent the end of the female/box portion from flaring or expanding when tightened. In one embodiment shoulder of pin end and shoulder of box end are tapered. In one embodiment the tapers are substantially parallel to each other and tend to cause the box end to be squeezed/directed towards the internal axial passageway of the mandrel.

Ratio Between Wall Thickness of Pin by Pin to Box by Box End Joints

In one embodiment the ratio between wall thicknesses of mating joints of mandrel are least 2:1, 3:1, 4:1, 5:1, 6:1, 7:1, 8:1, 9:1, 10:1, 12:1, 14:1, 16:1, 18:1, and 20:1. In various embodiments the ratio can be between any two of the specified ratios. In one embodiment, the wall thicknesses of the box/female by box/female end joints are designed to be shearable in the ram blow out preventers.

In one embodiment the different wall thicknesses can be seen in Pin/male by Pin/male joints of mandrel compared to Box/female by Box/female joints of mandrel.

In this embodiment the wall box by box end joints' wall thicknesses are designed to be shearable in the ram blow out preventers.

Mandrel Comprised of Double Pin End Joints and Double Box End Joints

In one embodiment the mandrel can be comprised of a plurality of double box/female by box/female end joints connected by double pin/male by pin/male end joints, wherein the double pin end joints are spaced apart at least 4, 5, 6, 7, 8, 9, 10, 12, 14, 16, 18, 20, 25, 30, 35, 40, 45, 50, 55, 60, 65, 70, 75, 80, 84, 85, 90, 95, and 100 feet. In various embodiments the double pin end joints can be spaced between any two of the above specified lengths.

In various embodiments the double pin end joints, in length, can be less than 48 inches, 46, 45, 44, 42, 40, 38, 36, 34, 32, 30, 28, 26, and 24 inches. In various embodiments the length of the double pin end joints can be between any two of the above specified lengths.

Sleeve with Two Spaced Apart Seal Units Dealing with Recessed Areas of Mandrel

In one embodiment, within the stroking length of the exterior sealing area of the mandrel with respect to the sleeve/housing includes at least one recessed area in the external sealing surface of the mandrel (which recessed area is used for supporting the weight of the drill string and swivel tool during the process of tripping in the swivel tool into the well bore). In one embodiment the mandrel includes a plurality of recessed areas spaced apart the longitudinal length of the mandrel and within the stroking length of the sleeve/housing.

In various embodiments such recessed area or areas can cause a seal unit in the sleeve/housing to lose partial or complete sealing between sleeve and mandrel when such seal unit passes over the recessed area. In various embodiments, such a partial or complete loss of sealing of one seal unit is compensated by the remaining seal of the other spaced apart sealing unit (which maintains a seal between sleeve and mandrel on the external sealing surface of the mandrel).

In various embodiments, one or more recessed areas in the external sealing portion of the mandrel includes at least one transition piece which is of a softer material than the material comprising the external sealing area of the mandrel, for example teflon compared to steel. Other examples include rubber, viton, plastic, polymer, In one embodiment, the mandrel can be stroked/reciprocated with respect to the sleeve/housing causing one or more recessed areas in the external sealing area of the mandrel to pass through the sleeve. In one embodiment, with the sleeve having first and second spaced apart sealing, the mandrel is moved relative to the sleeve wherein:

(1) first and second seal units maintain independent sealing between sleeve and mandrel;
(2) first seal unit moves across recessed area of mandrel but second seal unit maintains seal between sleeve and mandrel; or,
(3) second seal unit moves across recessed area of mandrel but first seal unit maintains seal between sleeve and mandrel.

In one embodiment, the longitudinal length of one or more recessed areas in the mandrel can be between 1, 2, 3, 4, 5, 6, 7, 8, 9, 10, 11, 12, 14, 16, 18, 20, 22, 24, 26, 28, 30, 32, 34, 36, 40, 45, 50 inches; and the spacing between the spaced apart seal units in the sleeve/housing.

Sealing Inserts for Thin Walled Sections

One embodiment includes inserts for the thin walled sections of box/female by box/female joints of mandrel.

One embodiment has the inserts being slidable relative to the joint of mandrel in which the insert is contained.

One embodiment has the inserts having an internal bore transition, from small to large bore internal flow passage.

One embodiment includes the insert with an annular recess for at least partially containing an internal sealing unit.

General Method of Making Up Stroking Mandrel when on Rig

In one embodiment is provided a method of determining the stroking length of a rotating and reciprocable swivel tool at a drilling rig or platform having a floor, comprising the steps of:

(a) providing a swivel tool, the swivel tool comprising a mandrel and a sleeve, the mandrel being rotatable and reciprocable relative to the sleeve/housing, the mandrel having a first stroke length relative to the sleeve/housing;

(b) supporting in a substantially vertical direction the swivel tool at the rig;

(c) adding a mandrel joint to the top of the mandrel, such additional joint increasing the stroking length of the mandrel relative to the first stoking length;

(d) lowering the swivel tool and again supporting in a vertical direction the swivel tool in a substantially vertical direction on the rig; and (e) repeating steps "c" and "d" unit the final stroking length of the mandrel relative to the sleeve/housing is at least 100 feet.

In various embodiments the steps "c" and "d" can be repeated until the final stroking length can be greater than about 100, 150, 200, 250, 300, 350, 400, 450, 500, 550, 600, 700, 800, 900, 1000, 1200, 1400, 1500, 1600, 1800, and 2000 feet, or any stroke lengths between any two of the specified stroke lengths.

In various embodiments a plurality of the mandrel joints include recessed areas in the exterior sealing surface, and during step "c" one of these recessed areas is used to support the swivel tool in a substantially vertical direction.

In one embodiment the plurality of recessed areas can include soft material transition sections.

In various embodiments the upper portions of the recessed areas can be frustoconical.

In various embodiments the upper portions of the recessed areas can be tapered.

On embodiment comprises a method of increasing stroke length of the mandrel while located on rig or platform.

One embodiment comprises a method of making up the mandrel while on rig or platform.

General Method Steps

In one embodiment the method can comprise the following steps:

(a) lowering the rotating and reciprocating tool to the annular BOP, the tool comprising a sleeve and a mandrel;

(b) after step "a", having the annular BOP close on the sleeve;

(c) after step "b", causing relative longitudinal movement between the sleeve and the mandrel; and (d) after step "c", performing wellbore operations.

In various embodiments the method can include one or more of the following additional steps:

(1) after step "c", moving the sleeve outside of the annular BOP;

(2) after step "(1)", moving the sleeve inside of the annular BOP and having the annular BOP close on the sleeve;

(3) after step "(2)", causing relative longitudinal movement between the sleeve and the mandrel.

In one embodiment, during step "a", the sleeve is longitudinally locked relative to the mandrel.

In one embodiment, after step "b", the sleeve is unlocked longitudinally relative to the mandrel.

In one embodiment, after step "c", the sleeve is longitudinally locked relative to the mandrel.

In one embodiment, during step "c" operations are performed in the wellbore.

In one embodiment, during step "(3)" operations are performed in the wellbore.

In one embodiment, during step "c" the tool is fluidly connected to a string having a bore and fluid is pumped through at least part of the string's bore.

In one embodiment, during step "(3)" the tool is fluidly connected to a string having a bore and fluid is pumped through at least part of the string's bore.

In one embodiment, during step "c" the tool is fluidly connected to a string having a bore and fluid is pumped through at least part of the string's bore and fracturing operations performed.

In one embodiment, during step "(3)" the tool is fluidly connected to a string having a bore and fluid is pumped through at least part of the string's bore and fracturing operations performed.

In one embodiment, longitudinally locking the sleeve relative to the mandrel shortens an effective stroke length of the sleeve from a first stroke to a second stroke.

In one embodiment, during step "a", the mandrel can freely rotate relative to the sleeve.

In one embodiment, after step "b", the mandrel can freely rotate relative to the sleeve.

In one embodiment, after step "c", the mandrel can freely rotate relative to the sleeve.

To provide the completion engineers with the flexibility:

(a) to use the rotating and reciprocating tool while the annular BOP is sealed on the sleeve and while taking return flow up the choke or kill line (i.e., around the annular BOP); or (b) to open the annular BOP and take returns up the subsea riser (i.e., through the annular BOP); or (c) to open the annular BOP and move the completion string with the attached rotating and reciprocating tool out of the annular BOP (such as where the completion engineer wishes to use a jetting tool to jet the BOP stack or perform other operations requiring the completion string to be raised to a point beyond where the effective stroke capacity of the rotating and reciprocating tool can absorb the upward movement by the sleeve moving longitudinally relative to the mandrel) and, at a later point in time, reseal the annular BOP on the sleeve of the rotating and reciprocating tool (bypassing the top-drive unit).

In another embodiment the method can comprise the following steps:

(a) lowering the rotating and reciprocating tool to the annular BOP, the tool comprising a sleeve and mandrel;

(b) after step "a", having the annular BOP close on the sleeve;

(c) after step "b", causing relative longitudinal movement between the sleeve and the mandrel; and (d) during and/or after step "c", performing wellbore operations.

In various embodiments the method can include one or more of the following additional steps:

(1) after step "c", moving the sleeve outside of the annular BOP;

(2) after step "(1)", moving the sleeve inside of the annular BOP and having the annular BOP close on the sleeve;

(3) after step "(2)", causing relative longitudinal movement between the sleeve and the mandrel.

In one embodiment, during step "a", the sleeve is longitudinally locked relative to the mandrel.

In one embodiment, after step "b", the sleeve is unlocked longitudinally relative to the mandrel.

In one embodiment, after step "c", the sleeve is longitudinally locked relative to the mandrel.

In one embodiment, during step "c" operations are performed in the wellbore.

In one embodiment, during step "(3)" operations are performed in the wellbore.

In one embodiment, during step "c" the tool is fluidly connected to a string having a bore and fluid is pumped through the choke and/or kill of the BOP to the wellbore and returned through at least part of the string's bore up to the rig through a right angle swivel fluid diverter.

In one embodiment, during step "(3)" the tool is fluidly connected to a string having a bore and fluid is pumped through the choke and/or kill of the BOP to the wellbore and returned through at least part of the string's bore up to the rig through a right angle swivel fluid diverter.

In one embodiment, longitudinally locking the sleeve relative to the mandrel shortens an effective stroke length of the sleeve from a first stroke to a second stroke.

In one embodiment, during step "a", the mandrel can freely rotate relative to the sleeve.

In one embodiment, after step "b", the mandrel can freely rotate relative to the sleeve.

In one embodiment, after step "c", the mandrel can freely rotate relative to the sleeve.

To provide the completion engineers with the flexibility:

(a) to use the rotating and reciprocating tool while the annular BOP is sealed on the sleeve and while pumping fluid through the choke or kill line (i.e., around the annular BOP), and fluid is returned through at least part of the string's bore up to the rig through a right angle swivel fluid diverter; or (b) to open the annular BOP and take returns up the subsea riser (i.e., through the annular BOP); or (c) to open the annular BOP and move the completion string with the attached rotating and reciprocating tool out of the annular BOP (such as where the completion engineer wishes to use a jetting tool to jet the BOP stack or perform other operations requiring the completion string to be raised to a point beyond where the effective stroke capacity of the rotating and reciprocating tool can absorb the upward movement by the sleeve moving longitudinally relative to the mandrel) and, at a later point in time, reseal the annular BOP on the sleeve of the rotating and reciprocating tool.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

During drilling, displacement, and/or completion operations it may be desirable to perform down hole operations when the annular seal of an annular blow out preventer is closed on the drill string and rotation and/or reciprocation of the drill string is desired. One such operation can be a frac (or fracturing) operation where pressure below the annular seal 71 is increased in an attempt to fracture the down hole formation.

Figure 1:
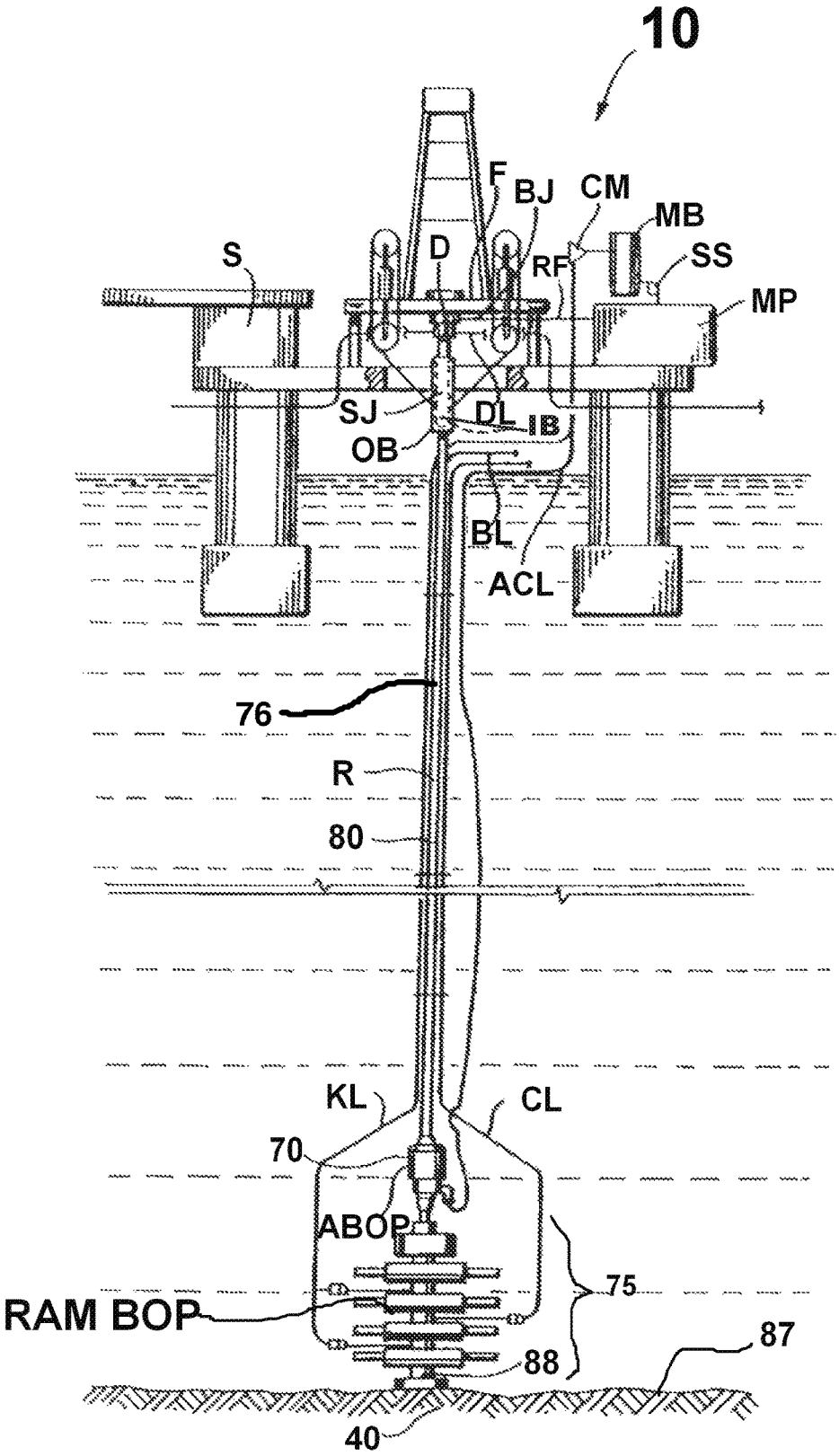
FIG. 1 is a schematic diagram showing a deep water drilling rig with riser and annular blowout preventer.

FIG. 1 shows generally the preferred embodiment of the apparatus of the present invention, designated generally by the numeral 10. Drilling apparatus 10 employs a drilling platform S that can be a floating platform, spar, semi-submersible, or other platform suitable for oil and gas well drilling in a deep water environment. For example, the well drilling apparatus 10 of FIGS. 1 and 2 and related method can be employed in deep water of for example deeper than 5,000 feet (1,500 meters), 6,000 feet (1,800 meters), 7,000 feet (2,100 meters), 10,000 feet (3,000 meters) deep, or deeper.

Figure 2:
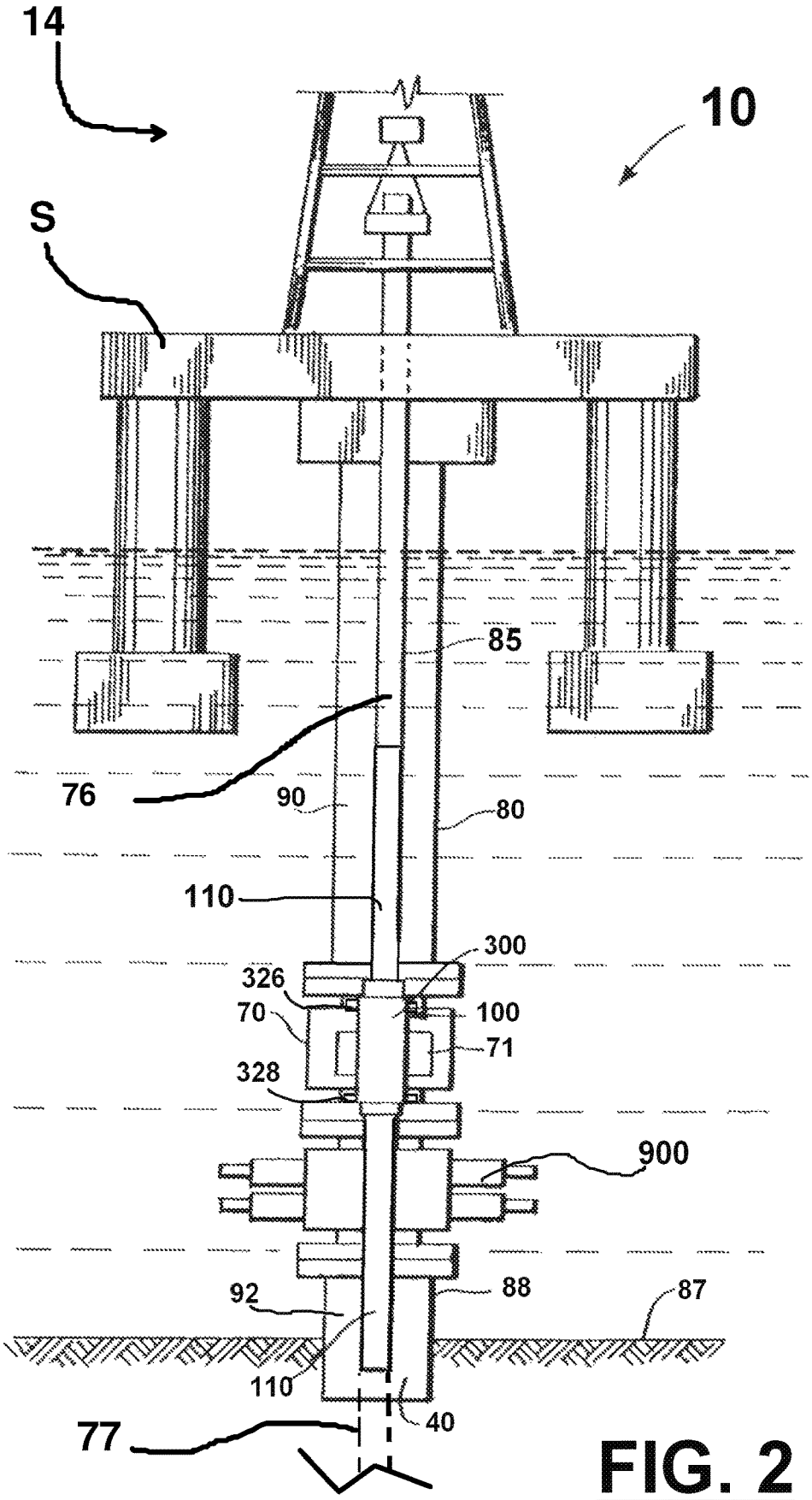
FIG. 2 is another schematic diagram of a deep water drilling rig showing a rotating and reciprocating swivel detachably connected to an annular blowout preventer, along with a ram blow out preventer mounted in the christmas tree below the annular blowout preventer.

In FIGS. 1 and 2, an ocean floor or seabed 87 is shown. Wellhead 88 is shown on seabed 87. One or more blowout preventers can be provided including stack 75 and annular blowout preventer 70. The oil and gas well drilling platform S thus can provide a floating structure S having a rig floor F that carries a derrick and other known equipment that is used for drilling oil and gas wells. Floating structure S provides a source of drilling fluid or drilling mud contained in mud pit MP. Equipment that can be used to recirculate and treat the drilling mud can include for example a mud pit MP, shale shaker SS, mud buster or separator MB, and choke manifold CM.

An example of a drilling rig and various drilling components is shown in FIG. 1 of U.S. Pat. No. 6,263,982 (which patent is incorporated herein by reference). In FIGS. 1 and 2 conventional slip or telescopic joint SJ, comprising an outer barrel OB and an inner barrel IB with a pressure seal therebetween can be used to compensate for the relative vertical movement or heave between the floating rig S and the fixed subsea riser R. A Diverter D can be connected between the top inner barrel IB of the slip joint SJ and the floating structure or rig S to control gas accumulations in the riser R or low pressure formation gas from venting to the rig floor F. A ball joint BJ between the diverter D and the riser R can compensate for other relative movement (horizontal and rotational) or pitch and roll of the floating structure S and the riser R (which is typically fixed).

The diverter D can use a diverter line DL to communicate drilling fluid or mud from the riser R to a choke manifold CM, shale shaker SS or other drilling fluid or drilling mud receiving device. Above the diverter D can be the flowline RF which can be configured to communicate with a mud pit MP. A conventional flexible choke line CL can be configured to communicate with choke manifold CM. The drilling fluid or mud can flow from the choke manifold CM to a mud-gas buster or separator MB and a flare line (not shown). The drilling fluid or mud can then be discharged to a shale shaker SS, and mud pits MP. In addition to a choke line CL and kill line KL, a booster line BL can be used.

FIG. 2 is an enlarged view of the drill string or work string 85 that extends between rig 10 and seabed 87 having wellhead 88. Drill or work string 85 is supported at the floating structure S with a top drive and derrick 14. In FIG. 2, the drill string or work string 85 is divided into an upper drill 76 or work string and a lower drill 77 or work string. Upper string 76 is contained in riser 80 and extends between well drilling rig S and swivel 100. Lower drill string 77 connects to the lower end of mandrel 110. An upper volumetric section 90 is provided within riser 80 and in between drilling rig 10 and swivel or assembly 100. Swivel or swivel assembly 100 includes mandrel 110 and sleeve 300. A lower volumetric section 92 is provided in between wellhead 88 and swivel 100. The upper and lower volumetric sections 90, 92 are more specifically separated by annular seal unit 71 that forms a seal against sleeve 300 of swivel 100 via annular seal unit sealing against external sealing surface 302 of sleeve 300. Annular blowout preventer 70 is positioned at the bottom of riser 80 positioned above stack 75 and wellhead 88.

A well bore 40 extends downwardly from wellhead 88 and into seabed 87. Although shown in FIG. 2, in many of the figures the lower completion or drill string 85 has been omitted for purposes of clarity.

FIGS. 1 and 2 are schematic views showing oil and gas well drilling rig 10 connected to riser 80 and having annular blowout preventer 70 (commercially available). FIG. 2 is a schematic view showing rig 10 with swivel 100 separating. Swivel 100 is shown detachably connected to annular blowout preventer 70 through annular packing unit seal 71. In FIG. 2, mandrel 110 is shown.

Mandrel 110 is contained within a bore of sleeve 300. Swivel 100 includes an outer sleeve or housing 300 having a generally vertically oriented open-ended bore that is occupied by mandrel 110. Sleeve 300 is rotatably and reciprocably connected to mandrel 110. Between the exterior face 114 of mandrel and interior of sleeve 300 is an interior volume 118 which volume can be sealed by spaced apart sealing units 370 and 380. Spaced apart sealing units 370 and 380 can be conventionally available sealing units.

Sleeve 300 provides upper catch, shoulder or flange 326 and lower catch, shoulder or flange 328. On upper catch 326 can be located upper wiper housing 12, and on lower catch 328 can be located lower wiper housing 15. Each wiper housing can include a wiper clamp 30 and wiper 17. Wiper clamp 30 can include upper 31 and lower 32 clamping rings. Wiper apparatus 11 can comprise upper and lower wiper units having upper and lower spaced apart wipers 17.

Figure 3A:
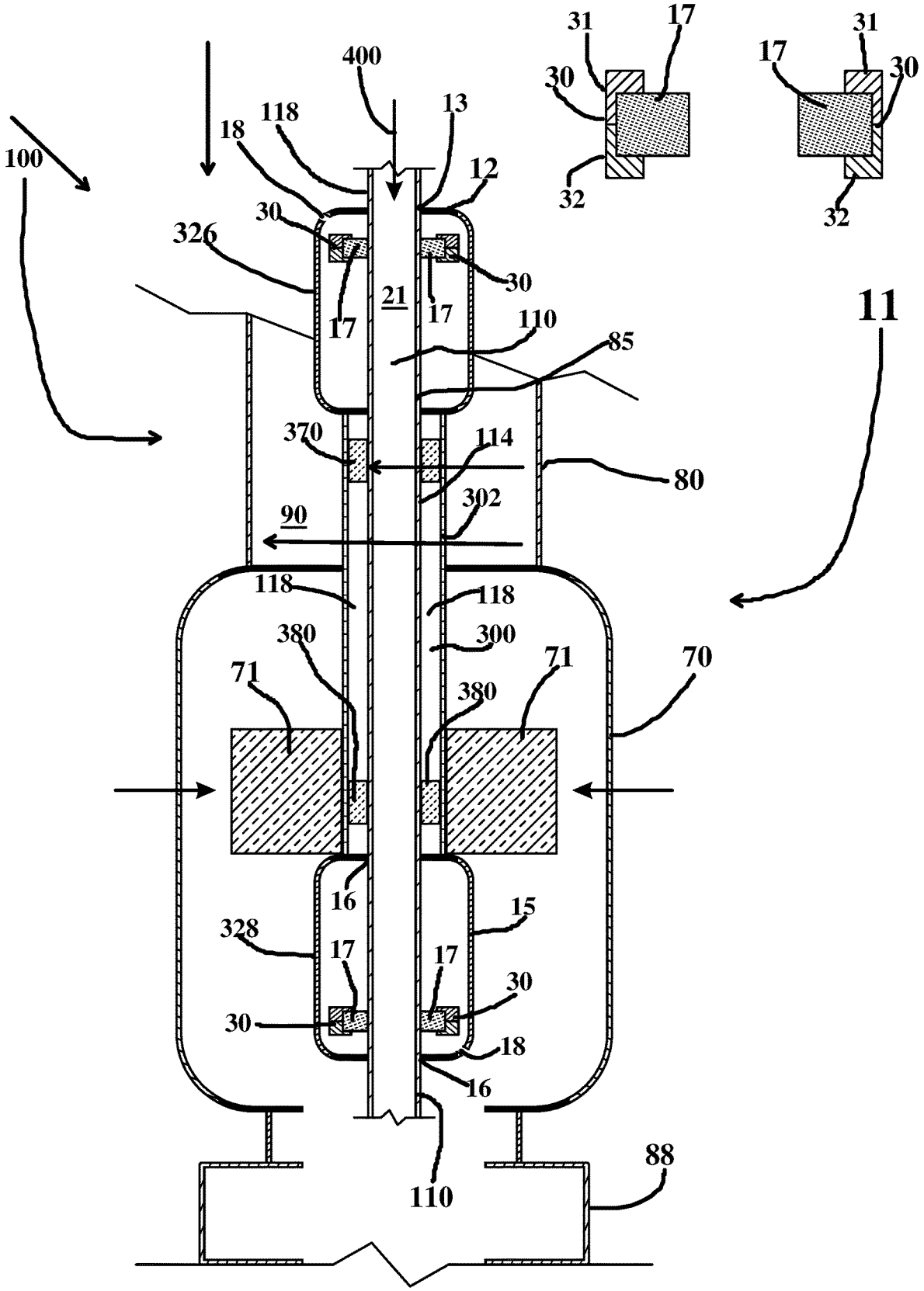
FIG. 3A is an elevation view of the preferred embodiment of the apparatus of the present invention schematically showing annular seal unit in a closed state.
Figure 3B:
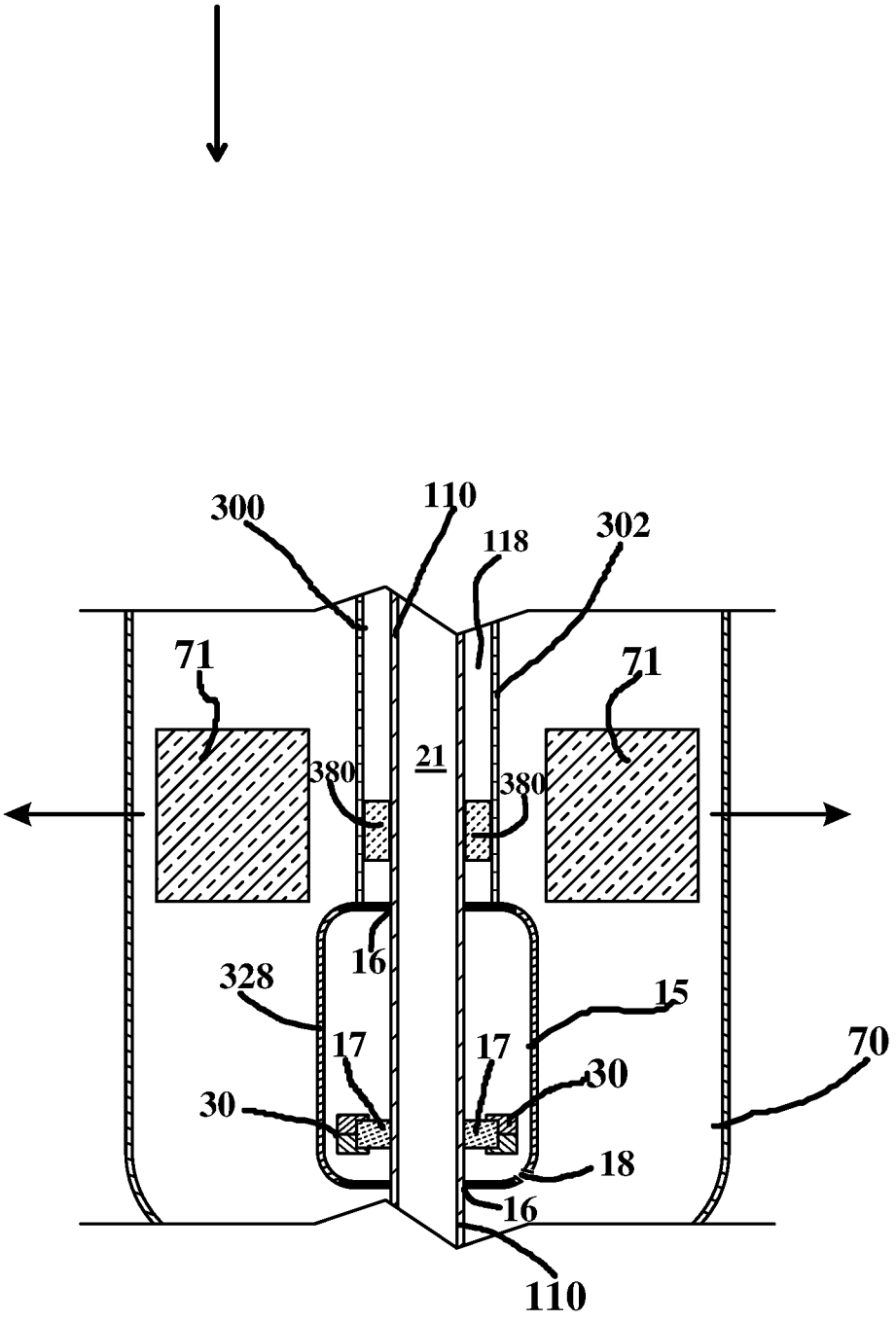
FIG. 3B is an enlarged partial view of the annular blowout preventer schematically showing annular seal unit in an open state.
Figure 4:
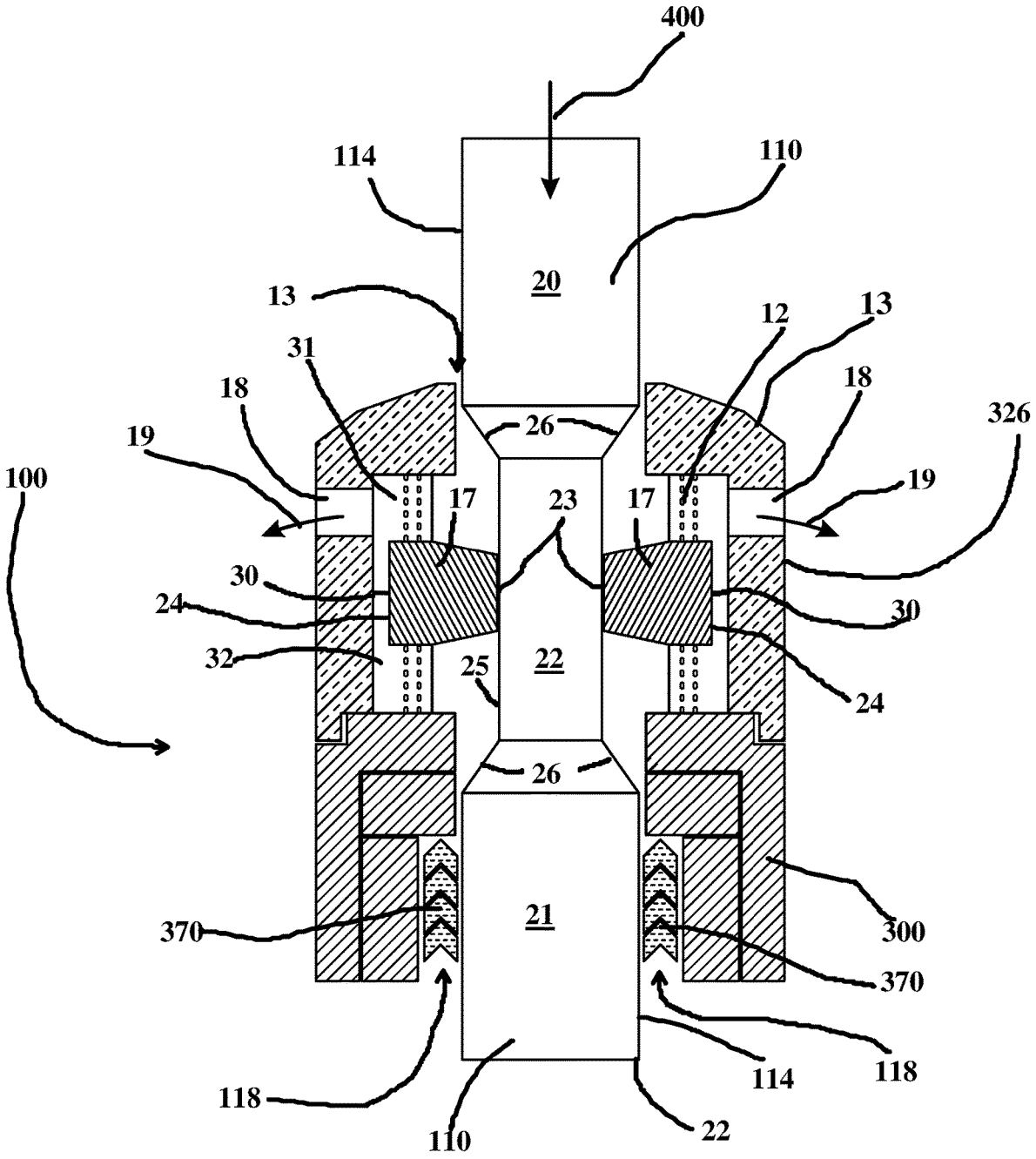
FIGS. 4-5 are fragmentary views of the preferred embodiment of the apparatus of the present invention.
Figure 5:
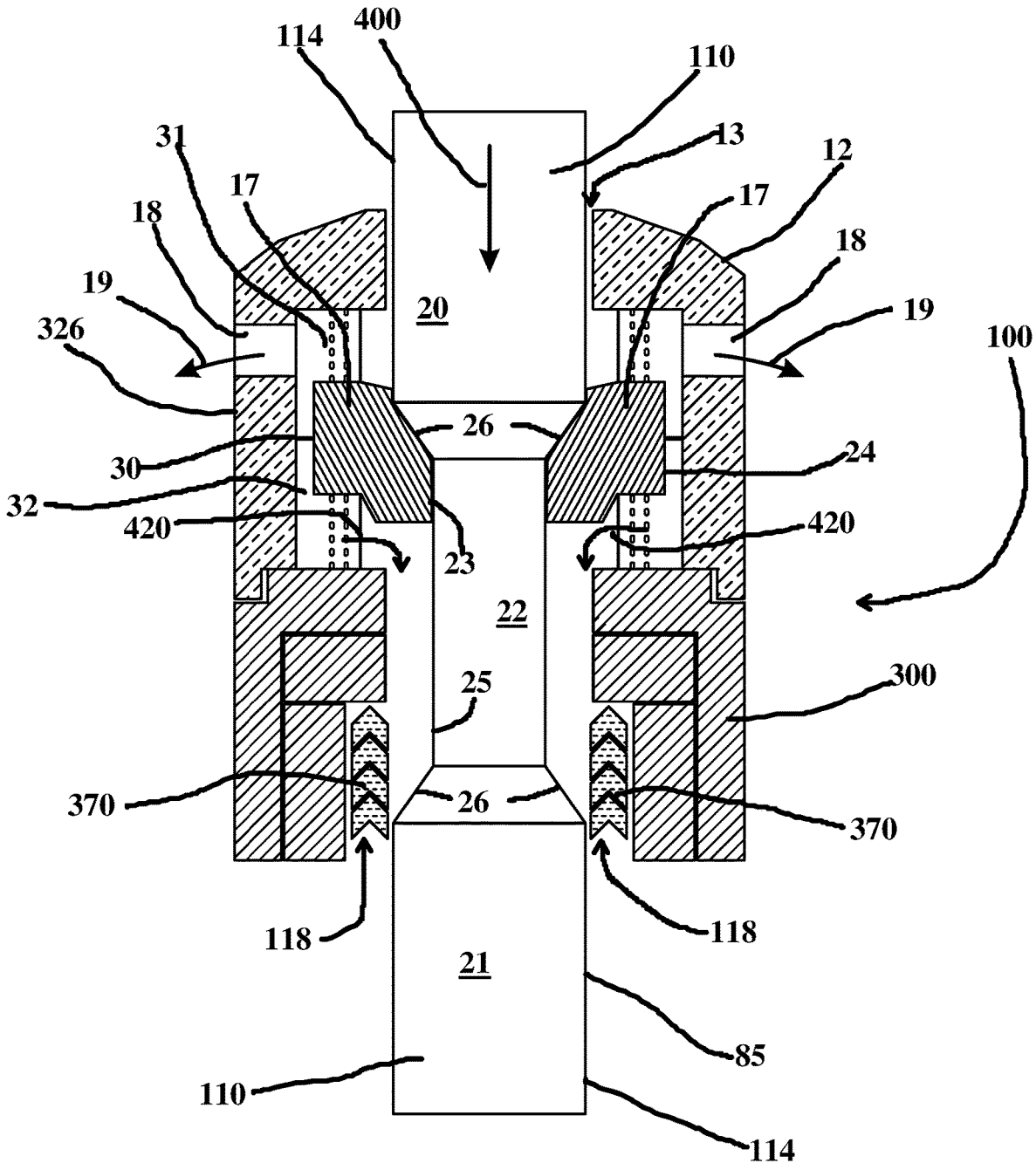

FIGS. 3-5 are fragmentary sectional views of the preferred embodiment of the apparatus of the present invention. In FIG. 3, there can be seen in more detail certain structures of FIGS. 1 and 2, namely the riser 80, mandrel 110, sleeve/housing 300, annular BOP (blow out preventer) 70, and seal 71 shown in a closed state. FIG. 3B is an enlarged partial view of the annular blowout preventer 70 schematically showing annular seal unit 71 in an open state. Wiper apparatus 11 provides spaced apart wiper housings 12, 15. Housing 12 is an upper wiper housing at the upper end of sleeve/housing 14. Housing 15 is a lower wiper housing at the lower end of sleeve housing 14.

Each wiper housing 12, 15 contains a wiper 17 as seen in FIG. 3A. Each wiper housing 12, 15 has openings 18 that enable mandrel 110 to pass vertically through the wiper housings and the sleeve/housing 14 as seen in FIG. 3. Wiper housing 12 has openings 13. Wiper housing 15 has openings 16.

As mandrel 110 moves longitudinally relative to sleeve 300 (such as in the direction of arrow 400 or in the opposite direction of arrow 400), mandrel 110 also moves longitudinally relative to upper and lower wiper housings 12 and 15. Spaced apart sealing units 370 and 380 maintain a seal for interior volume 118 by sealing against exterior surface 114 of mandrel 110. However, if dirt, grit, debris, and/or other items are located on exterior surface 114 such items can damage spaced apart sealing units 370 and 380 causing one or both to fail to seal interior volume 118. Upper and lower wipers 17 can be used to wipe, clean, and sweep the exterior surface 114 of mandrel to reduce, minimize, and/or eliminate dirt, grit, debris, and/or other possible damaging items from exterior surface 114 and prevent such items from damaging upper 370 and/or lower 380 sealing units.

FIG. 3A schematically shows mandrel 110 moving longitudinally relative to sleeve 300 in the direction of arrow 400. Upper and lower wipers 17 in upper 12 and lower 15 wiper housings also move in the direction of arrow 400 relative to mandrel 110. Such relative movement causes the lower wiper 17 in lower wiper housing 15 to wipe or sweep the exterior surface 114 of sleeve 110 thereby cleaning said exterior surface before lower sealing unit 380 sees said exterior surface 114 of mandrel 110. On the other hand relative movement in the direction opposite of arrow 400, causes upper wiper 17 in upper wiper housing 12 to wipe or sweep the exterior surface 114 of sleeve 110 thereby cleaning said exterior surface before upper sealing unit 370 sees said exterior surface 114 of mandrel 110. This wiping, sweeping, and/or cleaning of exterior surface 114 prevents, reduces, minimizes, and/or eliminates dirt, grit, debris, and/or other possible damaging items from damaging upper 370 and lower 380 sealing units thereby insuring the sealing of interior volume 118 and extending the sealing life of upper and lower sealing units 370,380.

Each wiper housing 12, 15 can have one or more ports or openings 18. Such ports or openings 18 enable discharge of debris that has been wiped from mandrel 110 by wipers 17 as indicated by arrows 19 in FIGS. 4 and 5.

It should be understood that mandrel 110 can have multiple sections of differing diameters for the exterior sealing surface 114. As seen in FIGS. 4 and 5, mandrel 110 can have larger diameter sections 20, 21 and smaller diameter section 22. Larger diameter sections 20,21 have the larger exterior sealing surface 114. However, smaller diameter section 22 can have a smaller surface 25 which diameter is smaller than the diameter of the exterior sealing surface 114 of larger diameter sections 20,21. Additionally, tapered sections 26 can be used to transition between the larger exterior sealing surface 114 and the smaller diameter sections 22.

Although upper 370 and lower 380 sealing units do not seal interior volume 118 when passing over smaller diameter sections 22 of mandrel 110, it is preferably to clean said smaller diameter sections 22 to prevent accumulations of dirt, grit, debris, and/or other possible damaging items in these smaller diameter sections 22 from accumulating. In various embodiments upper and lower wipers 17 can clean or sweep both larger exterior surface 114 and the exterior surface of the smaller diameter sections 22 as wipers pass by said areas in longitudinal movement relative to mandrel 110 (e.g., either in the direction of arrow 400 or in the opposite direction of arrow 400).

FIGS. 4 and 5 schematically illustrate the cleaning/sweeping process when passing by smaller diameter sections 22 of mandrel 110 for upper wiper housing 12. Arrows 420 schematically represent wipers 17 being bent downwardly by exterior inclined surface 26 and larger diameter section 20 of mandrel 110 as mandrel 110 moves in the direction of arrow 400 between FIGS. 4 and 5. The process for lower wiper housing 15 is substantially the same but would see relative movement in the opposite direction of arrow 400 (to visualize lower wiper housing 15 FIGS. 4 and 5 can each be rotated 180 degrees with the reference numerals for the lower wiper housing 15 inserted for their sister components found in the upper wiper housing 12).

Wipers 17 can have thicker section and a thinner section as seen in FIGS. 4 and 5. Wiper 17 can have thinner section 23 that engages mandrel 110 and thicker section 24 that is attached to wiper housing 12 or 15.

The smallest internal diameter of upper and lower wiper units 17 are preferably smaller than the diameter of the smaller diameter portion 22 of mandrel 110 to allow these upper and lower wiper units 17 to wipe, sweep, and/or clean when passing the smaller diameter portions 22.

The following is a parts list of reference numerals or part numbers and corresponding descriptions as used herein:

LIST FOR REFERENCE NUMERALS

| Reference Numeral | Description |
|---|---|
| 10 | drilling rig/well drilling apparatus |
| 11 | swivel with wiper apparatus |
| 12 | upper wiper housing |
| 13 | opening |
| 14 | top drive derrick |
| 15 | lower wiper housing |
| 16 | opening |
| 17 | wiper |
| 18 | port hole/opening |
| 19 | arrow |
| 20 | larger diameter section |
| 21 | larger diameter section |
| 22 | smaller diameter section |
| 23 | thinner section |
| 24 | thicker section |
| 25 | exterior surface |
| 26 | exterior inclined surface |
| 30 | wiper clamp |
| 31 | wiper clamp top ring |
| 32 | wiper clamp bottom ring |
| 40 | well bore |
| 70 | annular blowout preventer |
| 71 | annular seal unit |
| 75 | stack |
| 76 | upper drill string |
| 77 | lower drill string |
| 80 | riser |

-continued

LIST FOR REFERENCE NUMERALS

| Reference Numeral | Description |
|---|---|
| 85 | drill or work string |
| 87 | seabed |
| 88 | well head |
| 90 | upper volumetric section |
| 92 | lower volumetric section |
| 100 | swivel/swivel assembly |
| 110 | mandrel |
| 114 | exterior surface of mandrel |
| 118 | interior volume between sleeve and mandrel |
| 300 | swivel sleeve or housing |
| 326 | upper catch, shoulder, flange |
| 328 | lower catch, shoulder, flange |
| 370 | sealing unit |
| 380 | sealing unit |
| 400 | arrow |
| 410 | arrow |
| 420 | arrow |
| 900 | ram blow out preventer |
| BJ | ball joint |
| BL | booster line |
| CM | choke manifold |
| CL | choke line |
| CM | choke manifold |
| D | diverter |
| DL | diverter line |
| F | rig floor |
| IB | inner barrel |
| KL | kill line |
| MP | mud pit |
| MB | mud gas buster or separator |
| OB | outer barrel |
| R | riser |
| RF | flow line |
| S | floating structure or rig/drilling platform |
| SJ | slip or telescoping joint |
| SS | shale shaker |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

We claim:

1. A method of creating a rotating and reciprocating swivel tool while located on a drilling rig or platform, comprising the steps of:

(a) providing a swivel tool, the swivel tool comprising a mandrel and a sleeve being generally cylindrical with an exterior sealing surface and having a cavity and upper and lower end portions, creating an interior volume between the sleeve and mandrel, and upper and lower sealing units sealing the interior volume so that fluid above a said sealing unit is separated from fluid below a said sealing unit, the mandrel being rotatable and reciprocable relative to the sleeve, the mandrel extending into the cavity and having a first stroke length relative to the sleeve, the exterior sealing surface being located outside of the cavity;

(b) adding a mandrel joint to the top of the mandrel, such additional joint increasing the stroking length of the mandrel relative to the first stroking length;

(c) lowering the swivel tool into a riser and towards a blowout preventer and wellbore, and supporting the swivel tool in an upright orientation;

(d) repeating steps "b" and "c" until the final stroking length of the mandrel relative to the sleeve is at least 100 feet; and (e) at an end portion of the sleeve, wherein the seal of the blowout preventer can be selectively closed on the exterior sealing surface of the sleeve, and while the exterior sealing surface of the sleeve is detachably connected to the seal of the blowout preventer, the seal forms a seal against the exterior sealing surface of the sleeve separating upper and lower volumetric sections of fluid, the upper volumetric section being located in the riser above the blowout preventer and the lower volumetric section being located in the wellbore below the blowout preventer, wiping the mandrel with a wiper to prevent debris from coming into contact with at least one of the upper and lower sealing units.

2. The method of claim 1, wherein in step "e" the wiper engages the mandrel at the upper end portion of the sleeve.

3. The method of claim 1, wherein in step "e" the wiper engages the mandrel at the lower end portion of the sleeve.

4. The method of claim 1, wherein in step "e" the wiper engages the mandrel at both the upper and lower end portions of the sleeve.

5. The method of claim 1, wherein the mandrel has sections of differing diameters.

6. The method of claim 1, wherein in step "e" there is a wiper housing that contains the wiper and further comprising discharging debris from the wiper housing that is wiped from the mandrel.

7. The method of claim 6, wherein in step "e" the wiper housing has one or more ports and further comprising the step of discharging debris from the wiper housing via the port or ports.

8. The method of claim 7, wherein the ports include multiple ports that are circumferentially spaced apart and further comprising simultaneously discharging the debris from multiple ports.

9. The method of claim 6, wherein the wiper has thicker and thinner portions.

10. A method of creating a rotating and reciprocating swivel tool while located on a drilling rig or platform, comprising the steps of:

(a) providing a swivel tool, the swivel tool comprising a mandrel and a sleeve surrounding the mandrel, the sleeve having a generally cylindrical portion with an exterior sealing surface, said sleeve having a cavity and upper and lower end portions, an interior volume between the mandrel and sleeve which is sealed by a pair of spaced apart sealing units, each end portion having a wiper cavity with a wiper, the mandrel being rotatable and reciprocable relative to the sleeve, the mandrel extending into the cavity and having a first stroke length relative to the sleeve;

(b) lowering the swivel tool in a riser and towards a blowout preventer and wellbore, and supporting an upright orientation swivel tool;

(c) repeating step "b" until the final stroking length of the mandrel relative to the sleeve is at least 100 feet; and (d) detachably connecting the exterior sealing surface of the sleeve to a seal of the blowout preventer, wherein the seal of the blowout preventer can be selectively closed on the exterior sealing surface of the sleeve, and while the seal is closed and forms a seal against the exterior sealing surface of the sleeve and separates upper and lower volumetric sections of fluid, the upper volumetric section being located in the riser above the blowout preventer and the lower volumetric section being located in the wellbore below the blowout preventer, wiping the mandrel with one or both of the wipers to prevent debris from damaging the upper and/or lower sealing units.

11. The method of claim 10, wherein in step "d" the wiper engages the mandrel at the upper end portion of the sleeve.

12. The method of claim 10, wherein in step "d" the wiper engages the mandrel at the lower end portion of the sleeve.

13. The method of claim 10, wherein in step "d" the wiper engages the mandrel at both the upper and lower end portions of the sleeve.

14. The method of claim 10, wherein the mandrel has sections of differing diameters.

15. The method of claim 10, wherein in step "d" there is a wiper housing that contains the wiper and further comprising discharging debris from the wiper housing that is wiped from the mandrel.

16. The method of claim 15, wherein in step "d" the wiper housing has one or more ports and further comprising the step of discharging debris from the wiper housing via the port or ports.

17. The method of claim 16, wherein the ports include multiple ports that are circumferentially spaced apart and further comprising simultaneously discharging the debris from multiple ports.

18. The method of claim 10, wherein the wiper has thicker and thinner portions.

* * * * *